United States Patent [19]

Burkett

[11] Patent Number: 4,969,215

[45] Date of Patent: Nov. 13, 1990

[54] MEDICAL PATIENT'S GOWN

[76] Inventor: Patricia L. Burkett, 545 Pierce St. #2210, Albany, Calif. 94706

[21] Appl. No.: 309,171

[22] Filed: Feb. 13, 1989

[51] Int. Cl.[5] ..... A41D 13/12; A41D 10/00; A41B 9/00

[52] U.S. Cl. ..... 2/114; 2/DIG. 7

[58] Field of Search ..... 2/114, DIG. 7

[56] References Cited

U.S. PATENT DOCUMENTS

| | | | |
|---|---|---|---|
| 2,528,340 | 10/1950 | Coven | 2/114 |
| 2,768,383 | 10/1956 | DeWitt | 2/114 |
| 3,721,998 | 3/1973 | Meyers | 2/74 |
| 4,055,855 | 11/1977 | Ragone | 2/114 |
| 4,547,907 | 10/1985 | Netsky | 2/114 |
| 4,612,673 | 9/1986 | Underhill | 2/114 |
| 4,622,699 | 11/1986 | Spriggs | 2/114 |
| 4,653,120 | 3/1987 | Leaf | 2/114 |
| 4,718,124 | 1/1982 | Sawicki et al. | 2/114 |
| 4,737,995 | 4/1988 | Wiley | 2/114 |

*Primary Examiner*—Werner H. Schroeder
*Assistant Examiner*—Gloria Hale
*Attorney, Agent, or Firm*—Harris & Zimmerman

[57] ABSTRACT

A fabric gown is proportioned for wrapping around a medical patient's torso in an arrangement where a first edge of the fabric extends along the patient's back while the opposite edge overlaps the first edge and extends along one side of the patient. The overlapped portions of the fabric are fastenable at that side of the patient. The gown preferably has sleeves and a slit extends from the neck opening along each shoulder and the adjacent sleeve, the slits being normally closed by fasteners but being openable to enable access to the upper torso without removal of the gown. The shoulder slit fasteners are preferably cloth buttons and all other fasteners are also preferably formed of textile material. The gown does not gape open and embarass the patient but does provide for easy access to the patient's torso region when necessary. The gown facilitates nursing of infants, can be economically manufactured and maintained and, in the preferred form, does not have components which can disrupt X-ray images, muclear magnetic resonance scans or the like.

12 Claims, 2 Drawing Sheets

MEDICAL PATIENT'S GOWN

TECHNICAL FIELD

This invention relates to garments and more particularly to gowns of the type worn by patients in hospitals, medical clinics or the like.

BACKGROUND OF THE INVENTION

The street clothing of patients in hospitals and some other medical facilities is replaced with a gown-like garment which covers the patient's torso and which has an opening extending up the back that may be held closed by tie fasteners or the like. Conventional hospital gowns or patient gowns of this type lack the combination of characteristics which would best serve the needs of both the patient and the attending medical personnel.

An ideal patient gown would be one which can be easily put on and taken off either by the patient or by medical personnel. The gown should enable quick access to the patient's body by medical personnel but should not expose the patient's private parts under other circumstances such as when the patient is standing, moving about or sitting. The gown should be changable without disturbing IV equipment, ECG electrodes or other devices that may be attached to the patient's body. Fasteners with components made of metal or other material that may interfere with X-ray procedures, CAT scanning or NMI scans should not be present on the gown. It would be helpful if the gown enabled easy access to the breast region to facilitate nursing of infants or for medical procedures.

Conventional gown configurations tend to involve compromises between these several objectives. It is difficult for many patients to engage or disengage ties or other fasteners located at the back of the torso. Manipulation of such fasteners by medical personnel may require turning of a supine patient that would preferably be avoided. Prior gown designs that locate the fasteners at a more convenient location tend to complicate access to the patient's body, particularly in the back region. The standard gown design does not provide for access to the breasts without disrobing and many gowns have metal snaps or other fasteners that interfere with X-ray procedures and electronic scanning operations.

The tendency of the standard patient gown to gape and expose the posterior of a patient is notorious and a source of much embarrassment. Prior gown configurations which avoid this problem complicate access to the body.

There are also economic problems arising from the conventional patient gown designs. Maintaining an inventory of gowns of numerous different sizes adds significantly to hospital operating costs. Correction of misfittings consumes staff time. Metal snaps and similar fasteners tend to be damaged during the daily laundering process and may also abrade other materials during the laundering operation. Commonly used fasteners of the pressure sensitive type, in which an array of minute hooks on one tab engage minute loops on another tab, are also abrasive, wear quickly as a result of repeated laundering and accumulate unsightly lint which must be removed by hand. A more durable gown construction, fittable on patients of widely varying sizes, would significantly reduce the costs and complications of hospital operation.

The present invention is directed to overcoming one or more of the problems discussed above.

SUMMARY OF THE INVENTION

In one aspect, the present invention provides a medical patient's gown formed of fabric proportioned for wrapping around the patient's torso and having an upper region shaped for defining a neck opening, right and left shoulder regions and right and left arm openings. The gown has a configuration and proportions which enable wrapping of the fabric around the patient's torso in an arrangement in which a first side edge of the fabric extends along the patient's back while a second opposite side edge of the fabric overlaps the first edge and extends along the patient's torso. Means are provided for releasably fastening the overlapped portions of the fabric together at the predetermined side of the patient's torso.

In a further aspect of the invention, first and second shoulder straps extend from the fabric at the upper corners of the overlapped portions of the fabric at the back of the gown and means are provided for releasably fastening the shoulder straps to separate ones of the shoulder regions of the gown. In another aspect, the shoulder straps each have a button hole at the distal end and a plurality of buttons are attached to each shoulder region of the gown for engagement by the straps. The buttons at each shoulder region are at different spacings from the neck opening enabling engagement of the straps to selected ones of the buttons to accommodate to patients of different size. In still another aspect, the buttons are formed of compressible textile material.

In a further aspect of the invention, the gown has a slit in each shoulder region that extends from the neck opening to the adjacent arm opening and fasteners for holding the slits closed. The fasteners are disengageable enabling separation of the front and back portions of the shoulder regions to expose the upper torso of the patient at either or both sides. In a still further aspect, the gown may have sleeves having slits which are continuous with the slits of the shoulder regions.

In another aspect of the invention, a fabric gown for covering the torso of a medical patient has a torso encircling region, a neck opening, right and left shoulder regions and right and left sleeves. The fabric of the torso encircling region is proportioned to overlap at the back of the patient's torso a distance sufficient to enable a first side edge of the fabric to extend along the patient's back while an overlapped opposite side edge extends along the side of the patient's torso. The gown further has a pair of slit openings each of which extends from the neck opening along a separate one of the shoulder regions and along the adjacent sleeve. First fastening means releasably secure the overlapped portions of the fabric together at the side of the patient's torso, second fastening means couple the upper ends of the side edges to separate shoulder regions of the gown and third fastening means releasably secure the margins of each of the slit openings together at the shoulder regions of the gown.

The invention provides a patient's gown which enables easy access to the patient's body by medical personnel while also providing a high degree of comfort and ease of use to the patient. The patient need not manipulate fasteners at the back of the gown in order to don the garment or to disrobe. Medical personnel may dress or undress the patient without turning the patient's body. The gown does not gape open and expose the patient's back when the patient is sitting, standing or moving about. In the preferred form of the invention, the upper front portion of the gown may easily be dropped at one or both sides to expose the breasts for nursing or treatment. A single sized gown in accordance with the invention is comfortably fittable on individuals of widely varying sizes and proportions. The preferred form of the invention is free of abrasive or easily damaged fasteners and is highly durable when subjected to daily laundering. These characteristics of the gown can produce significant cost and staff time savings in the operation of hospitals or the like.

DETAILED DESCRIPTION OF THE PREFERRED EMBODIMENT

Figure 1:
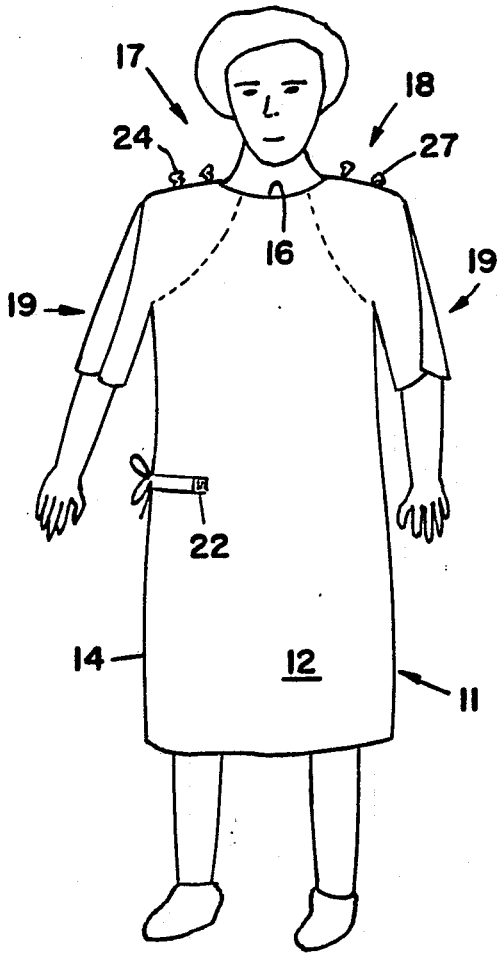
FIG. 1 is a front elevation view of the preferred embodiment of the invention as it appears when being worn by a standing medical patient.
Figure 2:
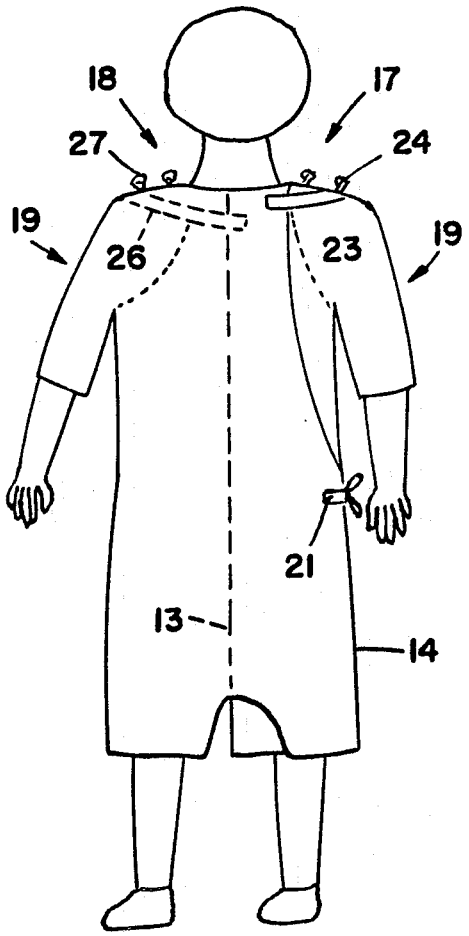
FIG. 2 is a back elevation view of the patients gown of FIG. 1 shown being worn by a standing patient.

Referring initially to FIGS. 1 and 2 in conjunction, a medical patient's gown 11 in accordance with this embodiment of the invention is formed of fabric 12 shaped and proportioned to to wrap around the patients body for approximately one and one quarter turns. This enables one side edge 13 of the fabric 12 to extend more or less along the center of the patient's back while the lower portion of the opposite side edge 14 extends along one side of the patient's body. The fabric 12 may be of any suitable type such as cotton for example and preferably has a length sufficient to cover the patient's torso and thighs although shorter or longer gowns may be appropriate under some conditions.

As will hereinafter be described in more detail, the upper portions of fabric 12 have a configuration which provides a neck opening 16 and right and left shoulder regions 17 and 18 respectively. To provide for warmth and a more attractive appearance, the gown 11 is preferably provided with sleeves 19 although sleeve-less versions of the gown are also possible.

The overlapping of the edges 13 and 14 of fabric 12 enables fastening of the waist region of the gown 11 at the side of the patient's body rather than at the back of the body which is more difficult. For this purpose a first flexible fabric tie ribbon 21 is secured to side edge 14 of fabric 12 at approximately waist level and a second similar tie ribbon 22 has one end secured to the fabric at a similar level at a location which is preferably somewhat around to the front of an average sized patient. This facilitates fitting of the gown 11 on patients of different girth.

The substantial overlapping of the fabric 12 at the back of the patient's body also avoids the embarrassment which has heretofore been a common occurrence as a result of gowns gaping open at the back when the patient is sitting, standing or moving about but does not impede access to the back of the patient's body by the patient or by medical personnel when necessary. Ties 21 and 22 can be easily disengaged and edges 13 and 14 of the fabric 12 may be folded back and spread apart when access to the back of the body is needed.

To accommodate to the overlapping, the upper portion of side edge 14 curves inward a small distance above tie 21 and then extends upward along the right side of the patient's back to locate the upper end of edge 14 near the right side of the back of the base of the patient's neck. A shoulder strap 23 is secured to fabric 12 at the upper end of edge 14 and fastens to a button 24 at the right shoulder region 17 of the gown as will hereinafter be described in more detail. Another shoulder strap 26 is secured to the fabric 12 at the upper end of edge 13 and fastens to another button 27 at the left shoulder region 18. The shoulder straps 23 and 26 prevent sagging of the upper corners of the fabric 12 while also allowing the upper region of the gown to be opened up as will hereinafter be described in more detail. This facilitates dressing and undressing, enables access to the upper torso without removing the gown and provides for comfortable nursing of infants.

Figure 3:
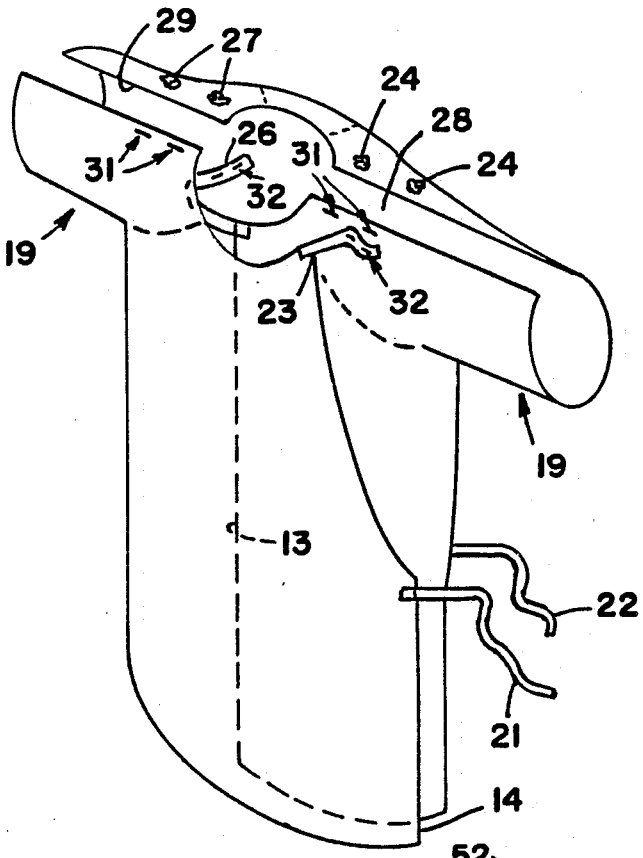
FIG. 3 is a perspective view of the patient's gown of the preceding figures shown with fasteners disengaged and in a slightly opened up condition.

The configuration of the upper region of gown 11 may be understood in more detail by reference to FIG. 3. In particular, a slit 28 in fabric 12 extends from the neck opening 16 along the right shoulder region 17 and continues along the entire length of the right sleeve 19. A similar slit 29 extends from the neck opening 16 along left shoulder region 18 and the entire length of the left sleeve 19. Preferably a spaced apart pair of the buttons 24 are secured to fabric 12 at the front margin of slit 28 and a pair of the buttons 27 are similarly secured to the fabric at the front margin of slit 29. Matching button holes 31 in fabric 12 at the back margins of slits 28 and 29 are engageable with buttons 24 and 27 to close the slits in the shoulder regions when access to the upper body is not desired. The sleeve 19 regions of slits 28 and 29 are not fastened closed but the margins of the slits in the sleeve regions tend to hang in an overlapping manner when the patient's arms are lowered.

As previously pointed out, shoulder straps 23 and 26 also engage on one of the buttons 24 and 27 when the gown 11 is in the normal closed configuration. For this purpose the distal ends of the straps 23 and 26 preferably have a series of spaced apart button holes 32. Providing more that one button hole 32 and the presence of pairs of buttons 24 and 26 at differing distances from neck opening 16 enables comfortable fitting of the gown 11 on patients of different sizes and proportions as either of the button holes 32 may be engaged with either of the buttons 24 or 27 at the corresponding side of the gown.

Figure 4:
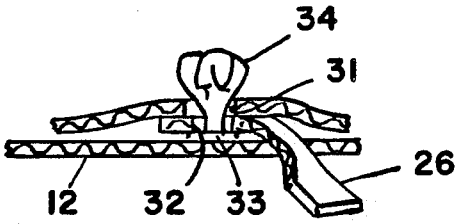
FIG. 4 is a partial section view showing a fastener and the manner of engagement of components at the left shoulder region of the gown.

The above described closure of slit 29 and engagement of shoulder strap 26 is depicted in FIG. 4. Button hole 32 of strap 26 is fitted onto button 27 first after which button hole 31 of fabric 12 is fitted onto the button over the strap. Referring again to FIG. 2, the process is reversed at the right shoulder where the right shoulder strap 23 is fitted on to button 24 over both portions of the fabric 12.

With reference again to FIG. 3, buttons 24 and 27 are of the cloth type, referred to in the trade as Chinese buttons, which are essentially knots of cord like textile. Referring to FIG. 4, such buttons 27 have a base 33 which can be stitched to fabric 12 and a compressible bulbous knot region 34 that can be forced through button holes 31, 32. Such buttons 27 are advantageous in that they are easily engaged and disengaged, are non abrasive and durable when repeatedly laundered.

Figure 5:
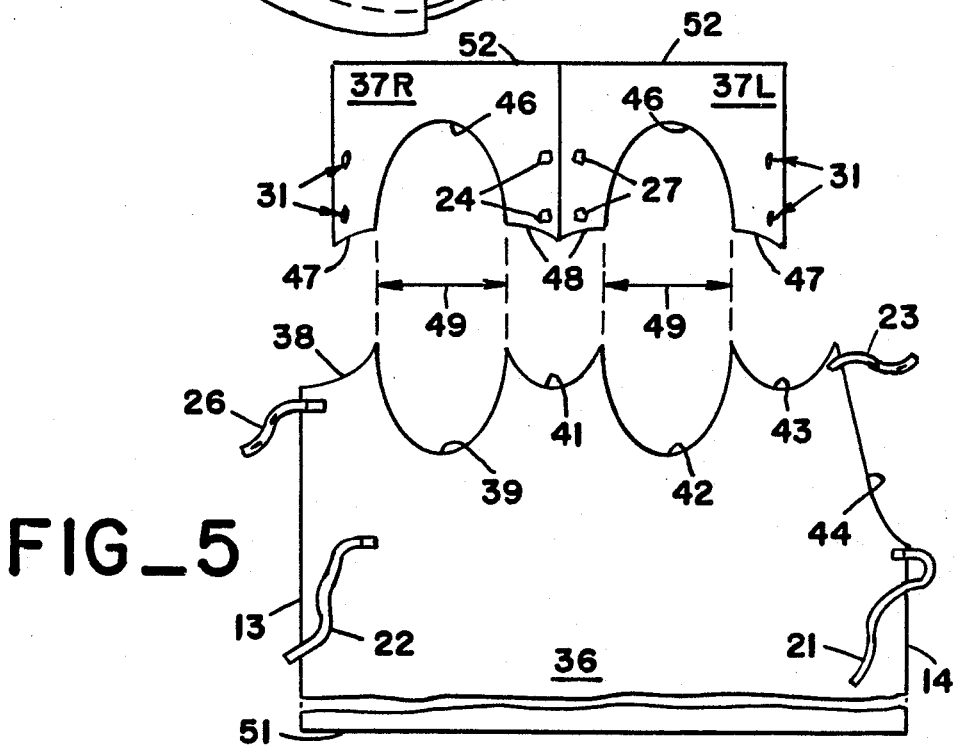
FIG. 5 illustrates a preferred pattern for making the patient's gown of the preceding figures using three pieces of fabric material and textile fasteners.

Referring to FIG. 5, the gown may be economically fabricated from three flat pieces of fabric material which include a main piece 36 and two shoulder-sleeve pieces 37R and 37L. The lower portion of the main piece 36 has a rectilinear outline and is proportioned to provide for the overlapping of opposite side edges 13 and 14 as heretofore described. A series of concave indentations 38, 39, 41, 42L, 43 and 44 are cut into the upper edge of the main piece 36. Indentation 41 defines the forward region of the neck opening of the gown and is not located midway between side edges 13 and 14 but is instead displaced towards edge 13 sufficiently to provide for the hereinbefore described overlapping of the edges of the gown.

Indentations 39 and 42 are situated at opposite sides of indentation 41 and are broader and deeper than indentation 41. Indentation 38 extends downward and outward from the outer high point of indentation 39 to the upper end of side edge 13 which is at a slightly lower level than the high points of indentation 39. Indentation 43 similarly extends downward and outward from the outer high point of indentation 42 but continues on and curves back up to the level of the high point of indentation 42. Indentation 44, which defines the upper portion of side edge 14, extends down and slightly outward from the outer high point of indentation 43 and then curves more outward to join the lower portion of the edge 14 substantially at the waist level of the gown.

Both shoulder-sleeve pieces 37R and 37fL may be cut to the same outline and may be rectilinear on three sides. A concave indentation 46 is cut into the fourth side of each shoulder-sleeve piece 37R and 37L and conforms in outline with the indentations 39 and 42 of the main piece 36. Piece 37R is proportioned to span indentation 39 and approximately one half of neck opening 41 and one half of indentation 38, the edges 47 and 48 of piece 37R that are adjacent indentation 46 having curvatures similar to the spanned portions of the indentations 38 and 41 of the main piece 36. The other shoulder-sleeve piece 37L has a similar indentation 46 and curved edges 47 and 48 although it spans indentation 42 and a portion of indentations 41 and 43 of the main piece 36 in a mirror imaged orientation relative to piece 37R.

Shoulder-sleeve pieces 37R and 37L are fastened to the main piece 36 by stitching or otherwise joining the margins of indentations 46 to the margins of the matching indentations 39 and 42 respectively of main piece 36 along the zones indicated by arrows 49 in FIG. 5. Prior to or after this stitching operation, the tie ribbons 21 and 22 and shoulder straps 23 and 26 are sewn or otherwise fastened to the main piece 36 at the locations which have been previously described. Similarly, button holes 31 are formed in the shoulder-sleeve pieces 37R and 37L and cloth buttons 24 and 27 are attached also at the locations previously described.

Bolts of manufactured fabric have a selvage or finished edge and economies in the fabrication of the gown can be realized by cutting the piece 36, 37R and 37L to utilize the selvage as the bottom edge 51 of main piece 36 and as the outer edges 52 of shoulder-sleeve pieces 37R and 37L. This makes it possible to dispense with the stitching of hems along edges 51 and 52.

A gown 11 formed in the above described manner assumes the configuration depicted in FIGS. 1 and 2 when fitted on to a medical patient's body. The previously described adjustments which can be made with shoulder straps 23 and 26 and at tie ribbons 21 and 22 enable fitting of persons of greatly varying physical size and thus reduce inventory requirement in hospitals or the like. As all fasteners 21, 22, 23, 24, 26 and 27 are formed of textile material in this preferred embodiment, the gown is not abrasive in the laundering process and is highly durable.

The described gown 11 configuration conceals the back of the body when the patient is sitting, standing or moving about but can be easily and quickly opened at the back when that is necessary. The location of all fasteners at the sides or top of the gown make the garment extremely easy to put on or take off and is particularly beneficial in this respect in the case of patients who may lack the manual dexterity needed to manipulate fasteners situated at the back of the gown.

While the invention has been described with respect to a single preferred embodiment for purposes of example, many variations and modifications of the gown are possible and it is not intended to limit the invention except as defined in the following claims.

I claim:

1. A medical patient's gown formed of fabric proportioned for wrapping around said patient's torso and having an upper region shaped for defining a neck opening, right and left shoulder regions and right and left arm openings, wherein the improvement comprises:

said gown having a configuration and proportions which enable wrapping of said fabric around said patient's torso in an asymmetric arrangement wherein a first side edge of said fabric extends along said patient's back while a second opposite side edge of said fabric overlaps said first side edge thereof and extends along a predetermined side of said patient's torso, the overlapped portions of said fabric being selectively separable from each other throughout their lengths including at the neck region of said gown, first means for releasably fastening the overlapped portions of said fabric together at said predetermined side of said patient's torso, and second means for releasably fastening the upper ends of said first and second side edges of said fabric to the shoulder regions of said gown.

2. The medical patient's gown of claim 1 wherein said second means includes first and second shoulder straps extending from said fabric at the upper corners of the overlapping portions of said fabric at the back region of said gown, and wherein said second means releasably fastens said shoulder straps to separate ones of said shoulder regions of said gown.

3. The medical patient's gown of claim 2 wherein each of said shoulder straps has a button hole at the distal end thereof, and wherein said second means includes at least one button attached to each of said shoulder regions of said gown.

4. The medical patient's gown of claim 3 wherein said buttons are formed of compressible textile material.

5. The medical patient's gown of claim 3 wherein a plurality of said buttons are attached to each of said shoulder regions of said gown, the button at each shoulder region being at different spacings from said neck opening enabling engagement of said straps to selected ones of said buttons to accommodate to patients of different size.

6. The medical patient's gown of claim 1 wherein said first edge of said fabric extends straight down from the neck region of said gown and said second edge of said fabric has a substantially straight lower region at the lower portion of said gown and an upper region which extends a distance inward towards said first edge at the upper region of said gown.

7. The medical patient's gown of claim 6 wherein said first means for releasably fastening the overlapping portions of said fabric together attaches to said second edge of said fabric substantially at the juncture between said upper and lower regions of said second edge.

8. The medical patient's gown of claim 1 wherein said gown has sleeves extending from said arm openings to said shoulder regions each of which sleeves has a permanently open slit extending therealong from the arm opening to the adjacent one of said shoulder regions and wherein said gown has an additional slit in each of said shoulder regions that extends from said neck opening to the adjacent one of said sleeves, said additional slits being continuous with said slits of said sleeves, and wherein said gown further includes fasteners for selectively holding said additional sits closed at said shoulder regions of said gown, said fasteners being disengageable to enable separation of the front and back regions of said shoulder regions of said gown to expose the upper torso of said patient at either or both sides of the torso.

9. The medical patient's gown of claim 8 wherein each of said shoulder regions of said gown has a plurality of button holes located adjacent said additional slit of that shoulder region and wherein said fasteners include a plurality of compressible cloth buttons attached to each of said shoulder regions of said gown, at the opposite side of said additional slit of the shoulder region.

10. The medical patient's gown of claim 9 wherein the material of each of said sleeves is proportioned to form an overlap along said slit of said sleeve.

11. A medial patient's gown formed of fabric proportioned for wrapping around said patient's torso and having an upper region shaped for defining a neck opening, right and left shoulder regions and right and left arm openings, wherein the improvement comprises:

said gown having a configuration and proportions which enable wrapping of said fabric around said patient's torso in an arrangement wherein a first side edge of said fabric extends along said patient's back while a second opposite side edge of said fabric overlaps said first side edge thereof and extends along a predetermined side of said patient's torso, and means for releasably fastening the overlapped portions of said fabric together at said predetermined side of said patient's torso, wherein said gown includes a main panel of said fabric proportioned for wrapping around said patient's torso in said overlapping arrangement and having an upper edge extending between said first and second side edges, said upper edge having a first concave indentation which defines the forward portion of said neck opening, said first indentation being located sufficiently closer to said first side edge than said second side edge to provide for said overlapping of said first and second side edges, said upper edge having second and third concave indentations located at opposites sides of said first indentation to define said arm openings, further including a pair of sleeve and shoulder pieces each being joined to said upper edge of said main panel along a separate one of said first and second indentations therein, each of said sleeve and shoulder pieces having fastening means for releasably securing opposite edges of the sleeve and shoulder pieces together in the shoulder regions of said gown.

12. A fabric gown for covering the torso of a medical patient, said gown having a torso encircling region, a neck opening, right and left shoulder regions and right and left sleeves, the fabric of said torso encircling region being asymmetrically proportioned to overlap at the back of said patient's torso a distance sufficient to enable a first side edge thereof to extend along the patient's back while an overlapped opposite side edge extends along a side of the patient's torso, the overlapped portions of said fabric being selectively separable from each other throughout their lengths including at the neck region of the gown, said gown further having a pair of slit openings each of which extends from said neck opening along a separate one of said shoulder regions and along the adjacent one of said sleeves, first fastening means for releasably securing the overlapped portions of said fabric together at said side of said patient's torso, second fastening means for coupling the upper end of said first side edge to one of said shoulder regions of said gown and for coupling the upper end of said second side edge to the other shoulder region of said gown, and third fastening means for releasably securing the margins of each of said slit openings together at said shoulder regions of said gown.

* * * * *